United States Patent [19]

Potocnik

[11] 4,370,799

[45] Feb. 1, 1983

[54] METHOD FOR MANUFACTURING UNFINISHED PARTS FOR PRESSED MATERIAL COMMUTATORS

[75] Inventor: Jože Potočnik, Idrija, Yugoslavia

[73] Assignee: Kolektor p.c., Idrija, Yugoslavia

[21] Appl. No.: 208,012

[22] Filed: Nov. 18, 1980

[30] Foreign Application Priority Data

Mar. 24, 1980 [YU] Yugoslavia ..... 817/80

[51] Int. Cl.[3] ..... H01R 43/08

[52] U.S. Cl. ..... 29/597; 29/418; 310/42; 72/256

[58] Field of Search ..... 29/597, 416, 418; 72/256; 310/233–236, 42

[56] References Cited

U.S. PATENT DOCUMENTS 3,708,872 1/1973 Ohuchi et al. ..... 29/597

*Primary Examiner*—Carl E. Hall

*Attorney, Agent, or Firm*—Fleit & Jacobson

[57] ABSTRACT

A method for manufacturing commutators for electric motors wherein a hollow cylindrical body is provided having longitudinal grooves and ridges on its inner surface. The circumferential widths of the inner grooves are initially larger than the desired ultimate widths. A plurality of longitudinal outer grooves are formed on the outer surface of the cylindrical body, the outer grooves each having a bottom wall radially spaced from the longitudinal axis a distance substantially equal to the radial spacing of the bottom walls of the inner groove from the longitudinal axis. The outer grooves are staggered circumferentially relative to the inner grooves and the spaces therebetween define a plurality of yieldable cross-pieces. Radially inwardly directed shrinking forces are applied uniformly to the outer surface of the cylindrical member to break the yieldable cross-pieces and thereby decrease the widths of the inner grooves, the decrease thereof being equal to the widths of the outer grooves.

4 Claims, 7 Drawing Figures

METHOD FOR MANUFACTURING UNFINISHED PARTS FOR PRESSED MATERIAL COMMUTATORS

The invention relates to a method for manufacturing pressed material commutators, wherein longitudinal grooves are provided in the inner surface of a hollow cylindrical copper body by cold forming in an arrangement having a plurality of spaced, inwardly directed ridges, the width of said longitudinal grooves measured in the circumferential direction being reduced by a subsequent radial shrinking of the copper body.

The present methods of this kind are especially applicable to manufacturing pressed material commutators with a large effective thickness of copper and a massive soldering flanged riser portion, such as commutators required e.g. for starting motors for automobiles. In the case of a large effective thickness of copper, the depth of the grooves interspacing the inwardly directed ridges of the finished commutator is comparatively great when compared to the width of the grooves which determine the insulation width, and as the edge life of the press dies enabling formation of longitudinal grooves by cold forming is low, the method of manufacture was changed in such a way that grooves with an increased width were formed in a copper body of greater diameter, whereupon the width of the grooves was reduced to the desired value by the radial shrinking of the copper body. An essential disadvantage of this known method, however, is that it can only be applied to copper bodies without a soldering flanged riser portion.

It is further particularly disturbing that due to bridges between the bottoms of the inner longitudinal grooves and the outer surface, which must be subjected to upsetting during shrinking, it is not possible to achieve a uniform reduction of the width or an exact spacing of the commutator grooves. The latter is very disadvantageous regarding a possibly requisite sawing out of a part of the insulation layer, as well as for electrical reasons.

Consequently, it is an object of the invention to provide a method for manufacturing pressed material commutators, which will also be suitable for unfinished parts with soldering flange riser portions and will without difficulty enable the maintenance of tight tolerances concerning both the spacing of the commutator grooves and the width of the insulation between the inwardly directed ridges even in cases when the commutators possess a great effective thickness of copper.

According to the present invention the object is attained by a method as defined in the preamble, wherein prior to the shrinking step there is formed in the outer surface of each ultimate inner ridge, whereby the ridges are spaced by the inner longitudinal grooves, an outer longitudinal groove having a depth which is approximately the same radial distance from the bottom thereof to the longitudinal axis of the copper body as is the radial distance from the bottoms of the inner longitudinal grooves to said longitudinal axis, the outer grooves further being staggered with respect to the adjoining inner longitudinal grooves, the resulting staggering of each inner and outer groove further yielding a cross-piece which breaks upon shrinking in the next step, the width of the outer longitudinal grooves being equal to the subsequently effected decrease of the width of each inner longitudinal groove. Due to the circumstance that upon shrinking the cross-pieces formed by the outer longitudinal grooves break between each inner longitudinal groove and the adjoining outer groove, these cross-pieces do not interfere with the uniform shrinking of the copper body. Consequently, the number of ridges is not altered through the shrinking step. It is further possible to limit the extent of the reduction of the width of the inner longitudinal grooves by the width of the outer longitudinal grooves, within tight tolerances, whereby size errors are avoided and, besides, the final width of the inner longitudinal grooves corresponding to the width of the insulation of a finished commutator can be maintained within tight tolerances.

Further processing of an unfinished part according to the invention can ensue in a known manner. Following the accomplished shrinking there can, e.g., be wedged supporting members into the inner grooves between the ridges in order to separate them for subsequently filling the grooves with the insulating plastic material, thereby enabling turning off the commutator in dependence upon the depth of the primary outer longitudinal grooves. The copper body can also be made in a known manner. Besides compact rings or plates, rings can be used which are formed from a sheet through rolling of the same. In that case the inner longitudinal grooves are preferably arranged in such a way that the abutment lies outside said longitudinal grooves.

In the case of a copper body having a flange for the formation of a massive soldering flanged riser portion there are radial grooves formed in the front side of the flange extending away from the cylindrical part and adjoining the inner longitudinal grooves, and in the other side of the flange there are provided radial grooves adjoining the outer longitudinal grooves. Between each inner longitudinal groove and the adjacent outer longitudinal groove of the flange, as in the cylindrical part of the copper body, there is provided a cross-piece which breaks upon subsequent shrinking and, consequently, does not impede the uniform shrinking of the copper body.

All grooves can be formed by cold extrusion in a single step, which represents an advantage in manufacture.

In the case of a preferred embodiment of the method according to the invention, each section of material closing the adjacent outer longitudinal groove, upon shrinking of the copper body and its optionally available flange, is firmly connected by friction welding to the longitudinal ridges having longitudinal grooves. The connection of these sections of material with the adjacent ridges results in the advantage that the unfinished part need not be held in composite form by a holding ring until it has been inserted into the tool for filling the insulating plastic material.

The invention will further be described in detail on the basis of drawings showing various manufacturing steps of an unfinished part according to the invention, wherein.

Figure 3A:
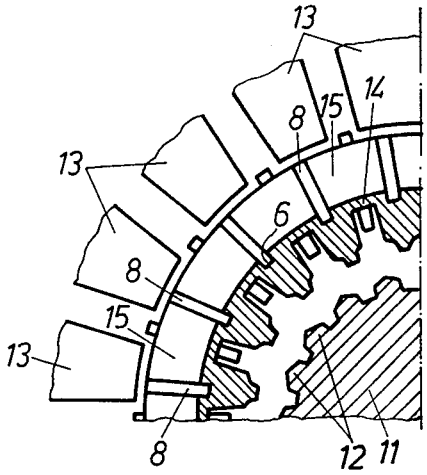
Figure 3B:
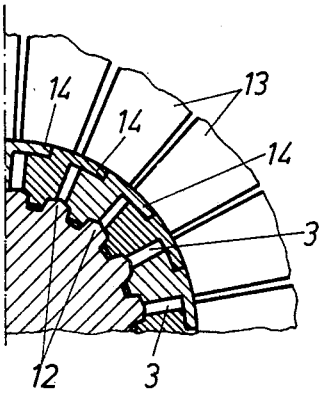
Figure 4A:
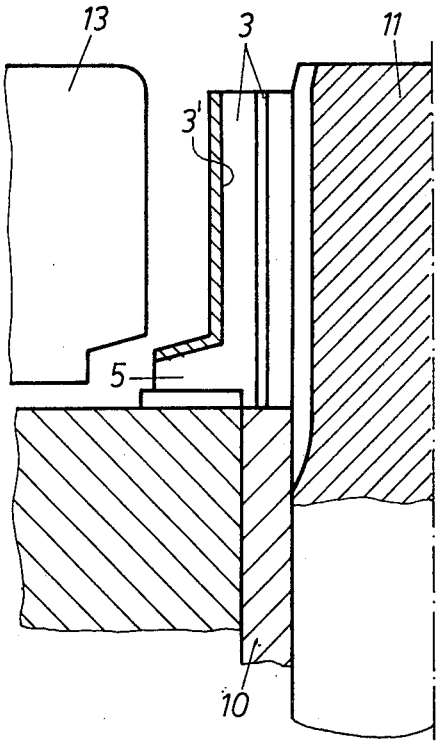

FIG. 3*a* is an fragmentary transverse section of an unfinished part inserted in a shrinking tool, prior to the shrinking operation;

FIG. 3*b* is an addition to FIG. 3*a* showing the situation subsequent to the shrinking operation;

FIG. 4*a* is a longitudinal section of FIG. 3*a;*

Figure 4B:
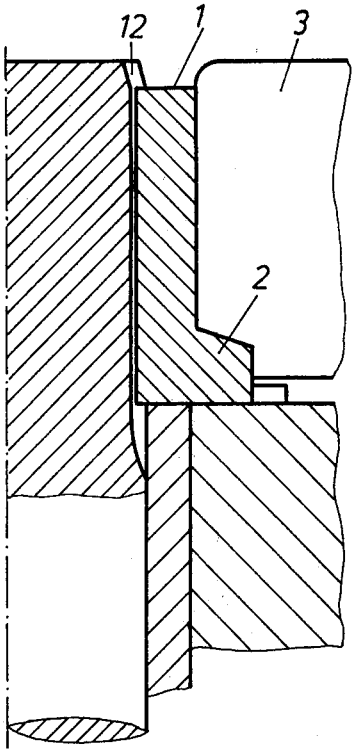

FIG. 4*b* is a longitudinal section of FIG. 3*b*; and

Figure 5:
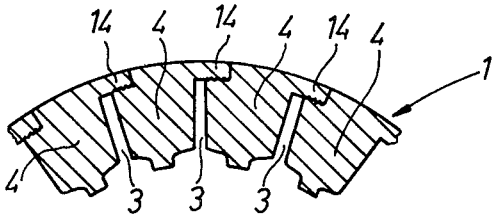

FIG. 5 is an enlarged, fragmentary transverse section of an unfinished part subsequent to the shrinking operation.

Figure 1:
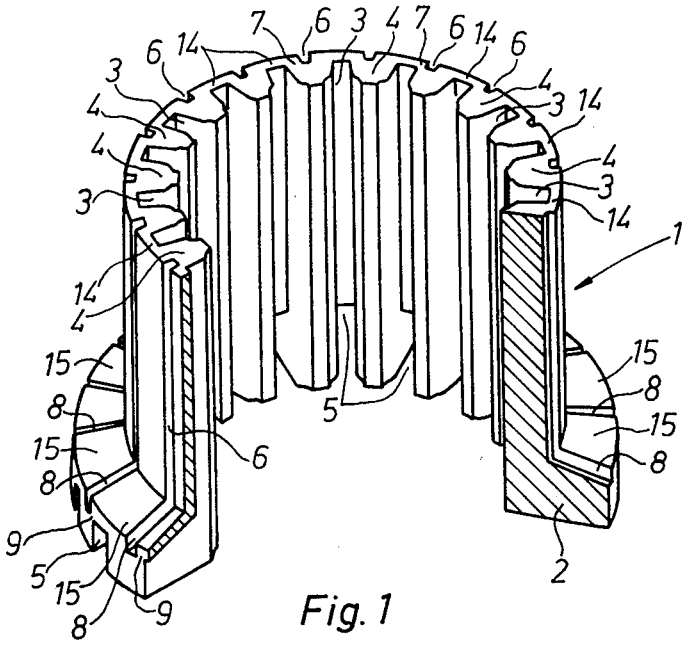
FIG. 1 is a perspective view, partly in axial section, of an unfinished part following the formation of the longitudinal grooves.

In a copper body 1 shaped as a hollow cylinder, having at one of its ends a flange 2 radially projecting outwards and manufactured by cold forming, there are provided in the inner surface, through a cold extrusion process by a star-shaped die, longitudinal grooves 3 lying in parallel both one to another and with respect to the longitudinal axis of the copper body 1, and disposed according to the desired size of the commutator to be manufactured. The depth of the longitudinal grooves 3 is so chosen that the distance of bottoms 3' thereof from the outer surface of the copper body 1 equals the thickness of the layer to be removed subsequent to filling the grooves with the insulating molded plastic. Thereby the depth of the groove corresponds to the radial height of the inwardly directed ridges 4 formed by the longitudinal grooves 3 in a finished commutator. The width of the longitudinal grooves 3 measured in the circumferential direction is, however, greater than the insulating width of the finished commutator, i.e., it is greater than the distance between two adjoining ridges of the finished commutator measured in the circumferential direction. Into the front area of the flange 2 which is oriented or the opposite side from the copper body 1 at its cylindrical part, there are also provided, through cold extrusion, radial grooves 5 as extensions of the longitudinal grooves 3. Consequently, the arrangement of the radial grooves 5 corresponds to the size of the commutator. As shown in FIG. 1, the depth of the radial grooves 5 is so chosen that the distance of the bottoms thereof from the other side of flange 2 adjacent body 1 equals the thickness of the layer subsequently removed.

Figure 2:
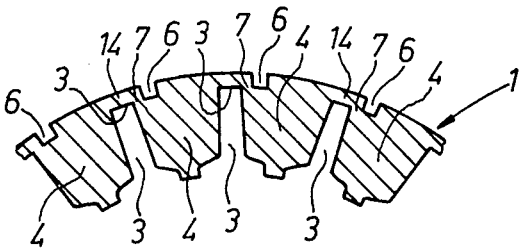
FIG. 2 is an incomplete transverse section in an enlarged scale of an unfinished part in the manufacturing step of FIG. 1.

Into the outer surfaces of the copper body 1 there are provided, by cold extrusion, outer longitudinal grooves 6, the number of which equals the number of inner longitudinal grooves 3. The depth of the outer longitudinal grooves 6 equals the thickness of the layer subsequently removed. Accordingly, the bottom of the outer grooves 6 lies in the cylindrical area defined by the bottoms of the inner longitudinal grooves 3. The width of the longitudinal grooves 6 measured in the circumferential direction equals the value for which the width of the inner longitudinal grooves 3 has to be reduced by subsequent shrinking of the copper body 1. The difference between the widths of one groove 3 and one groove 6, therefore, equals the insulating distance of the finished commutator. As particularly shown in FIG. 2, the outer longitudinal grooves 6 are staggered with respect to the inner longitudinal groove 3 in a circumferential direction, all in the same sense and all to the same extent. Thus, between the bottom 3' of each longitudinal groove 3 and the bottom of the adjoining longitudinal groove 6 there is provided a cross-piece 7 the width of which, however, measured in the circumferential direction, is so chosen that upon subsequent shrinking of the copper body 1 the cross-piece breaks approximately within a cylindrical area defined by the bottom 3' of the inner groove 3. In the embodiment shown, the width of the cross-piece 7 is somewhat smaller than the width of the outer grooves 6.

As an extension of the longitudinal grooves 6 there are provided in the front area of the flange 2 which is oriented adjacent to the cylindrical part of the copper body, radial grooves 8, as by cold extrusion. As evident from FIG. 1, the depth of these radial grooves 8 equals the thickness of the layer to be subsequently removed. As a result of this depth of the grooves and the staggering of the radial grooves 8 with respect to the radial grooves 5, there is also provided at the flange between each radial groove 5 and the adjoining radial groove 8 a thin cross-piece 9 which breaks upon subsequent shrinking of the copper body 1.

After all grooves have been worked in, the copper body 1 is placed in a shrinking tool which, as shown in FIGS. 3*a*–3*b*, 4*a*–4*b*, comprises a supporting star 11 guided displaceably in a longitudinal direction in a bushing 10. This supporting star, as its end part which can be interposed into the copper body 1, is provided with a number of fillets 12 which corresponds to the number of the longitudinal grooves 3 and is adjusted thereto. These fillets 12 are, as evident from FIGS. 3*a*–3*b*, profiled in such manner that they can engage with the longitudinal grooves 3 and abut against their flanks when the copper body 1 has shrunk to a correct size. Concentrically positioned relative to the supporting star 11, the shrinking tool is provided with radially movably arranged pressure pieces 13, the number of which corresponds to the number of fillets 12. These pressure pieces which, as shown in FIGS. 4*a*–4*b*, are so profiled that they can simultaneously be adjoined to the outer surface of the cylindrical part of the copper body 1 and to the outer surface of the flange 2, push each of the ridges 4 in a radial direction against the supporting star 11, as is evident from FIG. 3*b*. Because of this radial movement, the circumference of the copper body 1 is inevitably reduced and the cross-pieces 7 and 9 break according to FIGS. 3*b* and 5 in an area defined by the bottom of the longitudinal and radial grooves. The cross-pieces 14 and 15, which are provided radially outside the longitudinal grooves 3 and the radial grooves 5, respectively, are shifted into the longitudinal grooves 6 and radial grooves 8, respectively, after the cross-pieces have broken, in a circumferential direction, until they have completely filled said grooves. By this relative movement between the adjoining ridges 4, the width of the longitudinal grooves 3 and the radial grooves 5 is reduced to the final value since a further reduction of the circumference and, consequently, a further reduction of the width of said grooves is not possible when the cross-pieces have completely filled the grooves and abutted against the remaining flanks of the grooves. Due to the radial force exerted on the cross-pieces 14 and 15 upon shifting thereof into the longitudinal grooves 6 and radial grooves 8, respectively, there results a friction welding so that at the conclusion of the shrinking operation all ridges 4 are tightly connected by the cross-pieces 14 and 15, the copper body 1 thus again being a rigid body. Thereupon, the supporting star 11 is removed from the copper body 1, which is now supported by the bushing 10, and the holding part of the shrinking tool, the holding part being adapted to receive said bushing.

The shrunk copper body 1 can hereafter be handled without a holding ring or a similar element until it has been filled with an insulating molded plastic. As a rule, previous to filling the spaces between ridges 4 with the plastic, they are provided on the inner side with anchor picks formed by splitting off the ridges and essentially improving the connection between the ridges and the molded plastic body. Subsequent to filling with plastic, the cylindrical part of the copper body 1 and the flange 2 are turned down to such an extent that the cross-pieces 14 and 15 are removed.

I claim:

1. A method for manufacturing pressed material commutators from hollow cylindrical copper bodies having an inner surface which includes a plurality of longitudinal grooves separated by inner ridges at a predetermined spacing, the circumferential widths of said inner grooves being initially larger than the desired ultimate widths thereof, said method comprising:

forming a plurality of longitudinal outer grooves in the outer surface of said cylindrical body, said outer grooves each having a bottom wall spaced radially from the longitudinal axis of said body a distance substantially equal to the radial spacing of the bottom walls of said inner grooves from said longitudinal axis, said outer grooves being staggered circumferentially relative to said inner grooves to define a plurality of yieldable cross-pieces; and shrinking said body by means of radially inwardly directed forces applied uniformly to the outer surface thereof to break said yieldable cross-pieces, the decrease in the widths of said inner grooves being equal to the widths of said outer grooves.

2. The method according to claim 1, wherein said copper body is provided with a flange and in the front side of the flange oriented away from the cylindrical part there are formed radial grooves adjoining the inner longitudinal grooves, and in the other side of said flange there are formed radial grooves adjoining the outer longitudinal grooves.

3. The method according to claims 1 or 2 wherein said forming is accomplished in a single working step by cold extrusion.

4. The method according to claim 1 wherein during shrinking of the hollow cylindrical body each section of material closing the outer longitudinal grooves is firmly connected by friction welding to the inner ridges having these longitudinal grooves.

* * * * *